United States Patent [19]

Neveu

[11] 4,355,067

[45] Oct. 19, 1982

[54] SCOURING MATERIAL

[75] Inventor: Jean-Louis Neveu, Plerin, France

[73] Assignees: Agence Nationale de Valorisation de la Recherche (ANVAR); Institut Textile Boulogne-Sur de France, both of Seine, France

[21] Appl. No.: 186,467

[22] Filed: Sep. 12, 1980

[30] Foreign Application Priority Data

Sep. 20, 1979 [FR] France ..... 79 23875

[51] Int. Cl.[3] ..... B24D 11/02

[52] U.S. Cl. ..... 428/253; 15/118; 15/209 C; 15/209 R; 51/296; 51/298; 264/147; 264/DIG. 47; 428/300; 428/311.5; 428/371

[58] Field of Search ..... 51/298, 296; 15/209 R, 15/118, 209 C; 428/371, 253, 300, 311.5

[56] References Cited

U.S. PATENT DOCUMENTS

| | | | |
|---|---|---|---|
| 3,144,671 | 8/1964 | Gould | 15/1.5 |
| 3,345,668 | 10/1967 | Forrest | 15/209 |
| 3,582,418 | 1/1971 | Schur | 156/83 |
| 3,634,901 | 1/1972 | Landsberg | 15/209 R |
| 4,078,340 | 3/1978 | Klecker | 51/295 |
| 4,102,969 | 7/1978 | Neveu et al. | 264/147 |

FOREIGN PATENT DOCUMENTS

| | | |
|---|---|---|
| 2157167 | 11/1971 | Fed. Rep. of Germany . |
| 1239913 | 7/1960 | France . |
| 1522952 | 9/1975 | United Kingdom . |

*Primary Examiner*—James H. Derrington

*Attorney, Agent, or Firm*—Stevens, Davis, Miller and Mosher

[57] ABSTRACT

An improved fibrous scouring material is disclosed, that material comprising a fibrous band in the form of a three-dimensional lattice of drawn irregular fibers obtained from a plastic bilaminar film, those fibers being helically crimped and self-bonded together at their mutual contact points, the helically crimped fibers exhibiting sharp corner-edges and being interconnected by helically crimped fibrils. The thickness of the fibers is typically between 100 and 200 microns. The process for manufacturing such scouring material is also disclosed, which process includes steps of extruding a bilaminar film, drawing and fibrillating the film, stacking the fibrillated lattice and thermally treating same to induce crimping and self-bonding.

5 Claims, 6 Drawing Figures

25

SCOURING MATERIAL

The invention relates to a novel scouring material, even abrasive, in particular for household applications or for industry. It also relates to a manufacturing process for said material.

As is known, a "scouring substance" is a product which cleans by rubbing. On the other hand, an "abrasive" also cleans by rubbing, but additionally removes small amounts of the material being rubbed.

For some time already, a scouring means has been used in the form of a product of a non-woven sheet consisting of bristles or of coarse synthetic fibers, upon which is a pulverized binding product acting as an abrasive substance. Such a product, which is essentially formed of cavities, is described for instance in French Pat. No. 1,239,913.

In an improved version, this product is combined at one of its sides with a sponge. Even though this product is widely used, it nevertheless still presents several drawbacks. On the one hand it is costly because the base fibers themselves are expensive, and on the other hand, it degrades rapidly in use and vexatiously tends to clog with dirt.

Recently, scouring pads have been suggested which consist of agglomerated or knit strips of crushed, mechanically crimped bristles. Unfortunately this solution is of limited significance since on one hand only small pads are possible and on the other hand, and foremostly, it is difficult to clean products so made.

U.S. Pat. No. 3,345,668 describes a scouring pad consisting of flat laminations, arrayed in the three dimensions, cut in regular manner out of photographic films, and bonded at their contact points by an adhesive deposited on the film. The unitary products so obtained are difficult to cut out, since they may unravel, their cohesion being limited and the elasticity being mediocre.

The invention palliates these drawbacks. Its purpose is an economical scouring product, easily manufactured, even in various dimensions, and satisfactory in use.

This novel scouring product consists of a fibrous sheet of fibrous strips arrayed in the three dimensions, issuing from plastic films and bonded at least in part at their mutual contact points, said strips in their cross-sections exhibiting at least one sharp edge, the proportion of cavities with respect to the fibers being predominant in said material, which is characterized:

by being formed from irregular fibers arising from bilaminar films helically crimped and self-agglomerating at their mutual contact points, said elementary fibers being interconnected by fibrils which are also crimped;

and by the thickness of said drawn fibrils being between 100 and 200 microns.

In other words, this improved fibrous scouring material is characterized by being made into a fibrous strip of which the structure is a three-dimensional lattice formed of drawn, irregular fibers made from a plastic bilaminar film, helically crimped and self-agglomerating at their mutual contact points:

said elementary fibers comprising at least one sharp edge and being interconnected by fibrils also helically crimped;

the thickness of the drawn irregular fibrils being between 100 and 200 microns.

In one embodiment, the fibers are fibrillated, that is, they are obtained by dividing the film in the longitudinal direction.

Advantageously the fibrous sheet is non-woven and the cavity proportion is at least 75%. Nevertheless this proportion may be less for special cases. Additionally, the fibrous sheet also may be knit or woven.

It is mandatory that:

the functional fibers constituting the scouring sheet be of the bilaminar kind for the purpose of, on one hand, providing the three-dimensional structure in which the crimping is helical so as to improve the scouring properties, and on the other hand, assuring the self-agglomeration so as to fix said three-dimensional structure;

the cross-section of said fibers exhibit at least one sharp edge so as to provide a high tendency to loosen the scoured particles; this cross-section is practically rectangular as the fibers are obtained from films;

following drawing, the thickness of said fibers is on one hand at least 100 microns, as otherwise rigidity and hence scouring ability will be lost, and on the other hand at most 200 microns, as otherwise the product will be too rigid and hence cannot be fibrillated.

It must be emphasized that the rigidity of the fibers themselves while being a function of said thickness nevertheless depends on the nature of the selected polymers and the conditions of transformation of these polymers. On the other hand, it is essential that these fibers be resilient.

One process for manufacturing such a scouring material consists of extruding in known manner a bilaminar film through a plane die, drawing, and dividing this film lengthwise to obtain the fibers, storing the divided film and lastly thermally treating this drawn film at a high enough temperature to induce the potential crimping of said fibers and to induce bonding between the elementary fibrils at their contact points. This point is characterized in that said bilaminar film is at least 200 microns thick when leaving the die and in that following drawing, the fiber thickness is between 100 and 200 microns.

In one practical embodiment, the thermal treatment is carried out in several superposed and/or crossed fibrillated films, obtained for example by web-laying or napping and eventually needling together ultimately to improve the overall cohesion.

If, in general, the operational procedure is carried out on the film itself, it can then also be implemented on tapes cut from this film. In this case the tapes or laminations preferably are cut from the film already extruded but not yet drawn. In one advantageous mode, the drawn and eventually fibrillated tapes are transformed into a loosely knit or woven fabric before undergoing the thermal treatment.

As is known, a "bilaminar film" is a film in which the two main surfaces are made from different polymers that have stress-strain curves at the same temperature which do not coincide. These polymers may be chemically different. However, to improve the adhesion of their interlayers, identical polymers are used, though for instance their molecular weight, steric geometry, crystallinity, crystallization initiators and charges are different. An implementing process for such bilaminar films is described for instance in French Pat. No. 1,545,908 corresponding to U.S. Pat. No. 3,582,418; also in applicant's French patent application No. 2,306,818, corresponding to U.S. Pat. No. 4,102,969. In practice, the polymers are polyolefins, in particular polypropylene-based polyolefins. One film may be made of a homopolymer, the other of a copolymer, in particular a statistical copolymer. For instance one layer may be of homopolypropylene, the other of statistical polypropylenepolyethylene copolymer. Two different polymers also may be used, provided they are mutually compatible, for instance one a layer of polypropylene, the other a high-density polyethylene.

It was found that adding an acid terpolymer to the homopolymer composition—as described for instance in applicant's French patent application No. 2,306,818—facilitates the ultimate adhesion of the scouring material to a sponge.

The extrusion of these two polymers in the form of a bilaminar film through a thick, plane die is carried out in continuous manner, for instance using a plane bilamination die fed from two extruders. It is mandatory that the film leaving the die, that is the non-drawn film, be at least 200 microns thick, and preferably between 200 and 700 microns in thickness. Practically, this thickness is usually about 500 microns, so that after drawing, the thickness of the film or the strips is between 100 and 200 microns.

Advantageously, the extruded film is suddenly chilled between the die and the drawing station, in particular by being passed over a conventional apparatus known as "chill-roll".

The drawing of this thick, plane, bilaminar film is carried out in conventional manner, for instance using a set of rollers through a heated enclosure.

Similarly, the fibrillation takes place in known manner, for instance mechanically by means of needles borne on a cylinder (Burckhardt cylinder). Because of the substantial thickness of the film, these needles must be large and may be distributed more sparsely than conventionally at the cylinder surface. The result of fibrillation is to divide the film into a lattice of elementary fibrils as coarse as possible so that following the thermal treatment the material is rigid. Thus, by controlling the drawing rate and the degree of fibrillation, the fibril dimensions can be varied, and consequently their scouring properties are varied, too.

As is known, the fibrillated film (see FIG. 6) is in the form of a hairnet wherein the elementary drawn bilaminar fibers 30 are of irregular lengths and of irregular thickness comprising between 100 and 200 microns, and are interconnected by fibrils 31 of very slight cross-sectional compared to that of the elementary fibers 30.

The stacking also is carried out conventionally:

either on flanged bobbins when a fibrillated film is being wound;

or on a lapping machine when the film is being worked upon continuously;

or on cross-winding bobbins when strips or fibrillated layers are being wound.

All these extrusion, drawing, fibrillation and winding operations are continuous. The subsequent thermal treatment also may be continuous. However, on economical grounds, this treatment preferably is often carried out in a separate stage distinct from the primary fabrication of the fabrillated film.

The thermal treatment is carried out at sufficient temperatures and durations to crimp the elementary fibrils and to thermo-bond these fibrils at their contact points. The helical three-dimensional crimping imparts bulk and favors the formation of edges which provide the scouring action. The thermal bonding sustains the structure so obtained. Preferably, dry heat will be applied in:

either a shock oven, i.e., one in which the fibrillated film or the like (woven fabric, loose knit tapes) is subjected from either side to perpendicular hot air flows, or a conventional oven with the hot air circulating in the direction of advance of the film.

Preferably, this thermal treatment takes place in the absence of tension, but at a controlled shrinkage, that is, the percentage shrinkage is pre-determined to be compatible with the particular material so as to vary the crimping as a function of the desired results. Preferably the film or the like shrinks the maximum amount during the thermal treatment so as to obtain maximal crimping and thermal bonding. In this case the tension exerted on the wound finished product is virtually zero.

Under the influence of this thermal treatment (FIGS. 5 and 6) the irregular fibrillated bilaminar fibers (26–30) will crimp helically, whereby the scouring power is enhanced, the self-bond at their mutual contact points, whereby the overall structure acquires cohesion, so that handling of the sheets is made easier and their mechanical strength is improved. Simultaneously, the elementary fibrils (27–31) wil shrink while also crimping, which as a secondary effect substantially increases the cohesion of the lattice and the elasticity of the sheet, and hence its scouring performance.

As already stated, the invention is primarily in the selection of fibrillated fibers from bilaminar films as the scouring fibrous material, and fibers being already known. See in particular U.S. Pat. Nos. 3,582,418 and 4,102,969 cited above. In other words, it is surprising that into the structure described in U.S. Pat. No. 3,345,668—which teaches the use of cut-out, hence regular, tapes under certain conditions—another wholly different structure, namely a lattice of fibrillated fibers from bilaminar films, already known, can be successfully substituted, this substitution allowing:

on one hand, considerable improvement in scouring performance;

on the other hand, obtaining overall cohesion;

and lastly, cutting these sheets, in particular to bond them onto sponges, without appreciable risk of unraveling.

The illustrative embodiments shown in non-limiting manner below and in relation to the attached figures will show the way the invention can be implemented and the advantages it offers.

Figure 6:
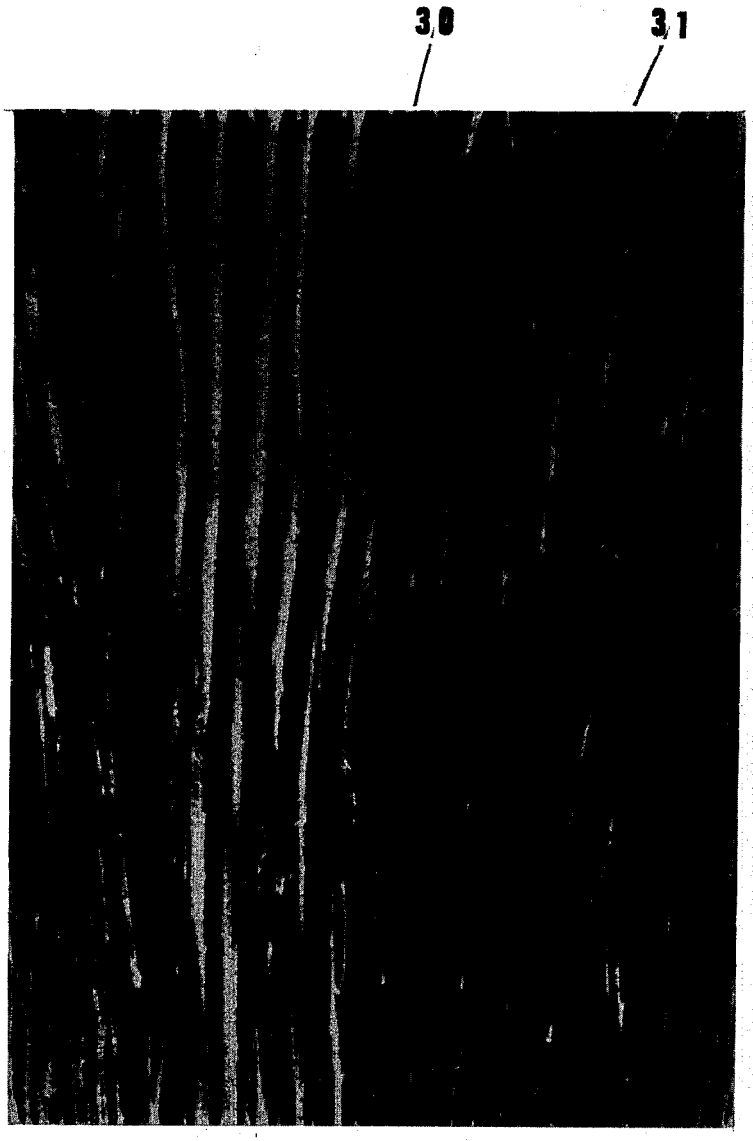

FIG. 6, as already mentioned, is a photograph of the lattice structure of a fibrillated film without thermal treatment.

Figure 1:
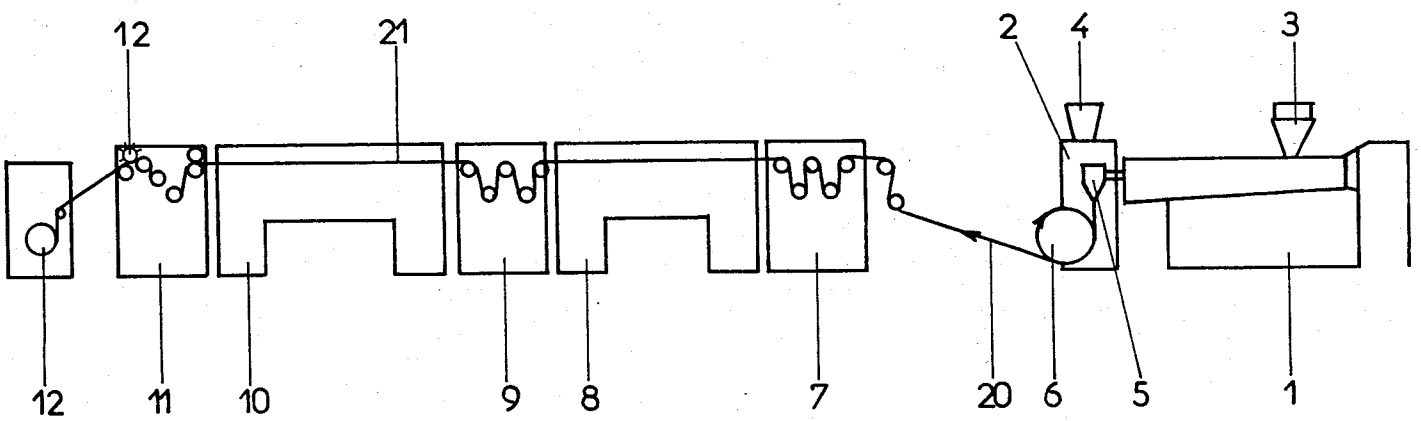
FIG. 1 is a side view of the coextrusion-drawing-fibrillation-stacking equipment.
Figure 2:
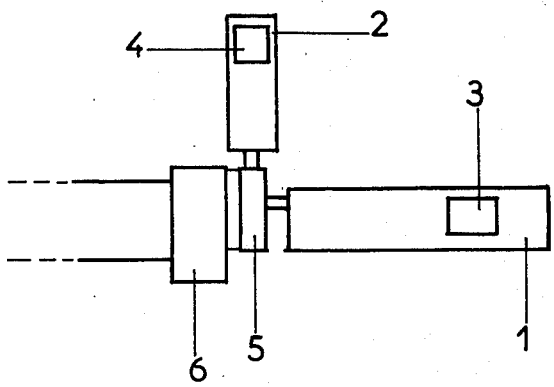
FIG. 2 is a top view of the extrusion apparatus of said equipment.
Figure 3:
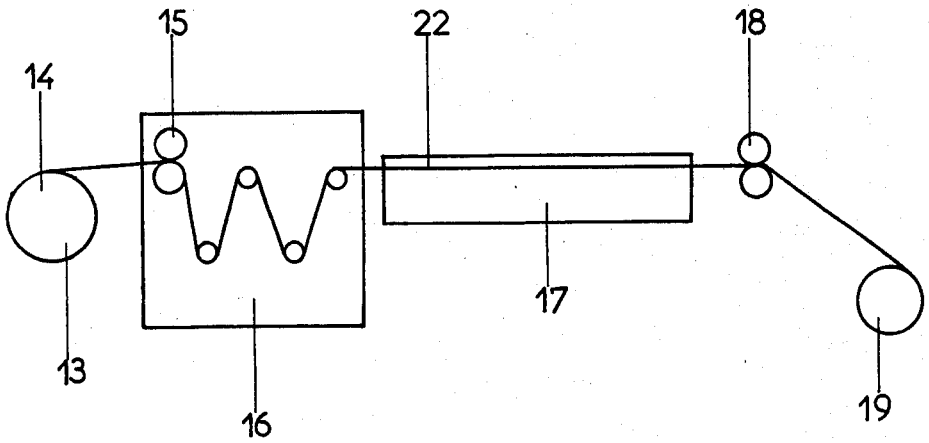
FIG. 3 is a side view of the separate stage for the thermal treatment apparatus.

The equipment used in FIGS. 1 and 2 is commercial, consisting of and operating as follows:

1 and 2 denote the single-screw extruders of the SAMOFAR models with a screw diameter of 75 mm for extruder 1 and 45 mm for extruder 2;

3 and 4 denote the loading hoppers for these two extruders;

5 denotes the plane bilaminar steel die 600 mm wide;

6 denotes a revolving cooling drum called "chill-roll" which is internally cooled by water; the non-drawn film leaving the die 5 is pressed on this cylinder 6 by a technique known as an air knife;

7 denotes the drawing apparatus, which is synchronized with cylinder 6;

8 denotes the hot air drawing oven;

9 denotes the drawing apparatus;

10 is an optional stabilizing oven;

11 are the stabilizing rollers;

12 denotes the 150 mm diameter fibrillating apparatus, with Burckhardt type needles comprising 6 needles per cm, sloping at 30° with respect to the vertical, with a projection of 4 mm, and comprising 16 bars on the periphery;

lastly, 13 denotes the stacking means for winding or otherwise. As regards FIG. 3:

14 denotes the roll means to receive the flange spool 13;

15 is a positive draw roll;

16 is the draw apparatus;

17 is the oven;

18 is a release or draw drum;

19 is a winding means.

EXAMPLE I

The installation of FIG. 1 is supplied and controlled as follows:

Extruder 1 is fed with a Lacqtene 30—30 BN1 homopolypropylene marketed by ATO CHIMIE; the rotational speed of the 75 mm diameter screw is 50 rpm, and the output is 40 kg/h;

Extruder 2 is fed with a polypropylene-polyethylene statistical copolymer marketed by ATO CHIMIE as Lacqtene 3020 SN3; the angular speed of the screw is 140 rpm and the output is 26 kg/h.

The die 5 is heated to 240° C.

The thickness of the stratified plane bilaminar film 20 at the exit of the die 5 is about 500 microns, its width being about 400 mm after the edges are cut off; the distribution by weight for the two layers of the bilaminar film is 40% of copolymer and 60% of homopolymer.

The drawing speed at 6 and 7 is 4.5 m/min.

The temperature in the hot air oven is regulated at 150° C. and the draw ratio between 7 and 9 is set at ten (i.e., a speed of 45 m/min. at 9).

The drawn film 21 averages about 150 microns in thickness.

The linear speed of rotation of the fibrillating machine 12 is controlled at 100 m/min and that of the winding spool 13 at 45 m/min.

A sample taken from the spool 13 is subjected to a moderate thermal treatment for 30 minutes at 130° C., whereby the maximum shrinkage, namely 70%, at that temperature is ascertained.

The output of spool 13 is at 14 (FIG. 3) where it unwinds at a speed of 20 m/min. The exit speed at 18 and that of winding at 19 is regulated at 6.5 m/min. and the temperature at 17 is 160° C. In this manner, the tension exerted on the fibrillated film 22 in oven 17 is practically zero and the lattice 22 is fully shrunk.

In this manner and after cooling, a three-dimensional lattice formed of coarse elementary fibrils helically crimped and mutually bonded at their contact points is obtained.

This sheet is cut into elementary sections that may be used as scouring products, either as such, or after having been bonded to one side of a viscose artificial sponge.

The finished product comprises 85% by volume of cavities and is quite well suited for use as a scouring material.

Figure 4:
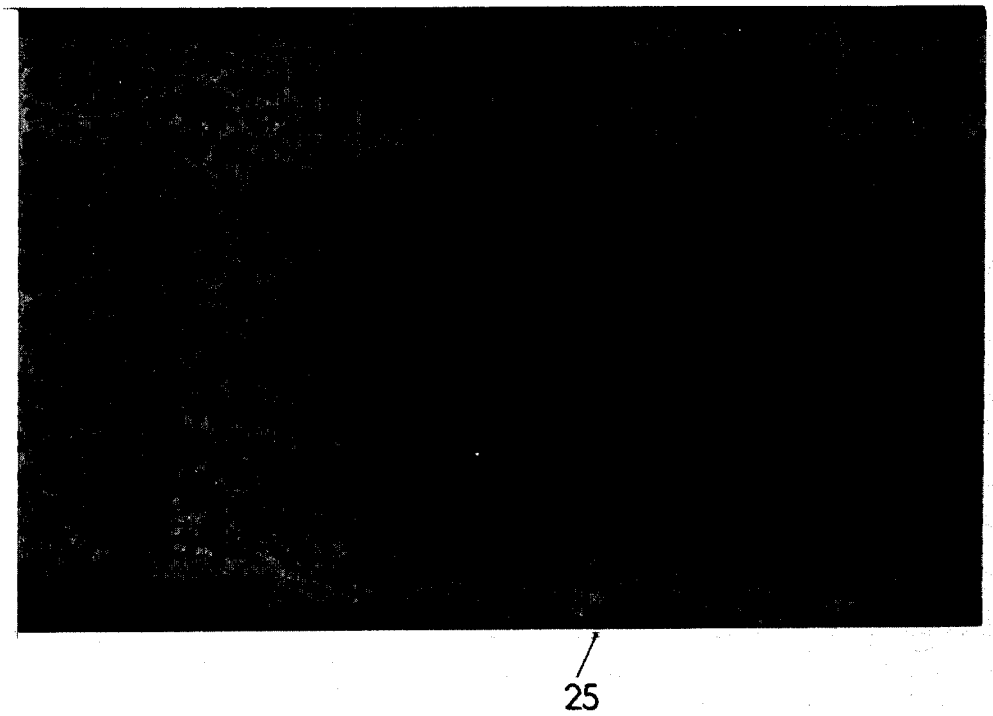
FIGS. 4 and 5 are photographs of the fibrillated film after thermal treatment (FIG. 4) and an enlargement of this film (FIG. 5)

FIG. 4 is a photograph of such a thermally treated fibrillated film, clearly showing the convoluted and bulky nature of this fibrous sheet.

Figure 5:
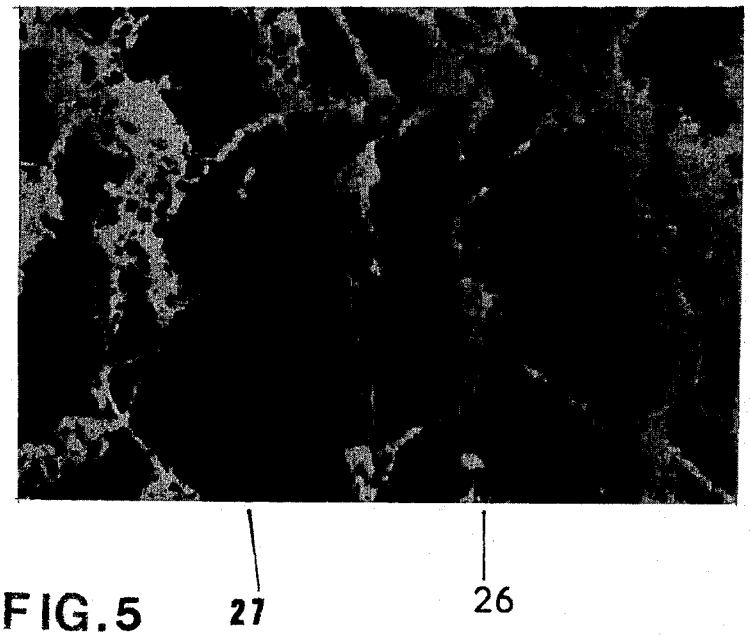

FIG. 5 is a photograph, much enlarged, of part of portion 25 of the fibrous eheet of FIG. 4; it clearly shows the irregular bilaminar fibers with sharp edges, crimped and self-agglomerated, and also the fibrils 27 connecting the fibers, which are also strongly helically crimped.

EXAMPLE II

Example 1 is repeated except that the draw ratio is set at twelve, consequently the speed of 9 and 13 is set at 52 m/min., and the thickness of the drawn film 21 is reduced to 130 microns.

Similar results to those of Example 1 are obtained, except that the material is slightly more flexible, the fibrils being finer.

EXAMPLE III

Example 1 is repeated, then several fibrillated films 13 are superposed by napping, the cohesion and the flexibility being improved using a needling machine with single stroke (ASSELIN), with drop-forged needles, and needling 80 times per square centimeter.

In this manner a thicker, wider and slightly denser material is obtained in which the cavity proportion is about 80%. This material is wholly suitable as a household scouring means.

EXAMPLE IV

The installation of FIG. 1 is modified in known manner in order to receive at 13—no longer a fibrillated film 21, but—drawn tapes, wound on cross spools.

Thereupon these tapes are passed onto a flat knitting machine for chain stitching, made by KARL MEYER and known for making wrapping bags. A bilaminar tape of polypropylene-polyethylene 45 microns thick and 2 mm wide is used as the warp.

The thermal treatment applied to the finished knit is the same as in Example 1.

A rough-textured material is obtained, which is easy to manufacture, has a fairly uniform geometry, and is suitable for use as a scouring means.

EXAMPLE V

Example 1 is repeated, except that the statistical copolymer is replaced by a polyethylene homopolymer marketed by NAPHTHA CHIMIE under the name NATENE 60-550 AG.

The die is heated to 230° C. and the sheet is treated at 130° C.

A fibrous product with essentially the same properties as in Example 1 is obtained.

EXAMPLE VI

Example 1 is repeated, but incorporating 5% by weight of an ethylene/vinyl acetate/acid terpolymer, marketed by E. I. du PONT de NEMOURS as ELVAX 42-60, into the polypropylene homopolymer according to the teaching of applicant's French Pat. No. 2,306,818.

The final product is similar to that in Example 1.

In this manner the adhesion to an artificial viscose sponge layer is improved, which is very advantageous when making compound materials wherein one side is for scouring, and one side is spongy.

The products and the process of the invention offer many advantages over the products marketed to date. Among these are:

the possibility to vary the structure of the finished material, hence the scouring properties, by controlling the implementing conditions: drawing ratio, temperature, fibrillation;

the possibility of using economical raw materials such as those based on polyolefins, in particular polypropylene;

the possibility of achieving a very porous finished structure, which is thus easy to cleanse;

an easily automated process, requiring no large investments;

the possibility of fabricating continuously or intermittently;

the possibility to obtain scouring properties, even abrasive properties, without introducing foreign substances or binding materials;

the possibility to cut the base sheet without unraveling;

the possibility to produce bulk-dyed products economically and on industrial scale;

Thus these products can be used successfully as industrial or household scouring products, or as substitutes for the bristle gloves used in body massage.

What is claimed is:

1. An improved fibrous scouring material, comprising a fibrous band having a structure of a three-dimensional lattice formed of drawn irregular fibrillated fibers obtained by fibrillation of a polypropylene-based bilaminar film, said fibers being helically crimped and self-bonded together at their mutual contact points and being interconnected by fibrils which are also helically crimped, wherein:

the fibrillated fibers are heat shrunk and include at least one sharp edge, the thickness of the fibrillated fibers is between 100 and 200 microns, and the fibrous band has a cavity proportion of at least 75%.

2. The scouring material of claim 1 wherein the fibrous band is non-woven and includes several superimposed needled bands.

3. The scouring material of claim 1 wherein the fibrous band is knit.

4. The scouring material of claim 1 wherein the polypropylene-based bilaminar film includes an ethylene/vinyl acetate/acid terpolymer and wherein the fibrous band is bonded to one surface of a sponge.

5. The scouring material of claim 1 wherein the cross-section of said fibers is substantially rectangular.

* * * * *